US006616305B1

(12) United States Patent
Simon

(10) Patent No.: US 6,616,305 B1
(45) Date of Patent: Sep. 9, 2003

(54) ILLUMINATION DERIVED FROM LUMINAIRES COMPRISED OF RADIAL COLLIMATORS AND REFRACTIVE STRUCTURES

(76) Inventor: Jerome H. Simon, 70 Sumner St., Newton Centre, MA (US) 02159

( * ) Notice: Subject to any disclaimer, the term of this patent is extended or adjusted under 35 U.S.C. 154(b) by 0 days.

(21) Appl. No.: 09/516,928

(22) Filed: Mar. 1, 2000

Related U.S. Application Data

(60) Provisional application No. 60/122,281, filed on Mar. 1, 1999.

(51) Int. Cl.[7] ..... F21V 13/12

(52) U.S. Cl. ..... 362/309; 362/327; 362/268; 362/331

(58) Field of Search ..... 362/309, 337, 362/331, 332, 336, 339, 327, 328, 268, 147, 245; 359/641, 710, 711

(56) References Cited

U.S. PATENT DOCUMENTS 4,969,074 A * 11/1990 Davis et al. ..... 362/327
5,613,749 A * 3/1997 Shikama et al. ..... 362/309
5,897,201 A * 4/1999 Simon ..... 362/268
6,027,231 A * 2/2000 Fouke ..... 362/309

* cited by examiner

*Primary Examiner*—Sandra O'Shea
*Assistant Examiner*—Bao Truong
(74) *Attorney, Agent, or Firm*—Jerry Cohen; Harvey Kaye; Perkins, Smith & Cohen

(57) ABSTRACT

A light assembly having a light source and a ring lens radially surrounding the light source for substantially collimating light from the light source. There is a prism ring having at least two prism bands surrounding the ring lens and receiving light from it. One of the prism bands is defined by a plurality of reflecting prisms and another of the prism bands is a refracting band. In another arrangement a multi-prism ring reflector surrounds the ring lens and is arranged to have total internal reflection except for exit faces formed therein which are substantially at right angles to the substantially collimated light from the light source. The ring prism bands may be of the same vertical height or they may have different vertical heights with respect to each other. In a further arrangement a prism ring includes at least two prism bands surrounding the ring lens and receiving light therefrom. Each of the bands has an inner surface and an outer surface and one of these surfaces of each band is inclined and adjacent another such surface and together therewith forms a continuous surface, and the other of these surfaces of each band is a wedge prism.

26 Claims, 9 Drawing Sheets

ILLUMINATION DERIVED FROM LUMINAIRES COMPRISED OF RADIAL COLLIMATORS AND REFRACTIVE STRUCTURES

CROSS-REFERENCE TO RELATED APPLICATIONS

This application is based upon and claims the priority of Provisional Application Serial No. 60/122,281, filed Mar. 1, 1999.

FIELD OF THE INVENTION

The present invention relates generally to the lighting field, and, more particularly, to creating illumination using luminaires having radial collimators and refractive structures.

SUMMARY OF THE INVENTION

It is an object of the present invention to provide a lighting system that provides lighting efficiently and in a flexible manner.

It is another object of the present invention to distribute illumination through the use of multiband refractors and using a ring lens around the light source.

It is a further object of the present invention to provide for the distribution of illumination using multi-prism bands.

These and other objects of the present invention are accomplished in the following manners, among others. A light distribution system is provided The means by which the foregoing objects and features of invention are achieved are pointed out in the claims forming the concluding portion of the specification. The invention, both as to its organization and manner of operation, may be further understood by reference to the following description taken in connection with the following drawings.

DETAILED DESCRIPTION OF THE PREFERRED EMBODIMENTS

Figure 1:
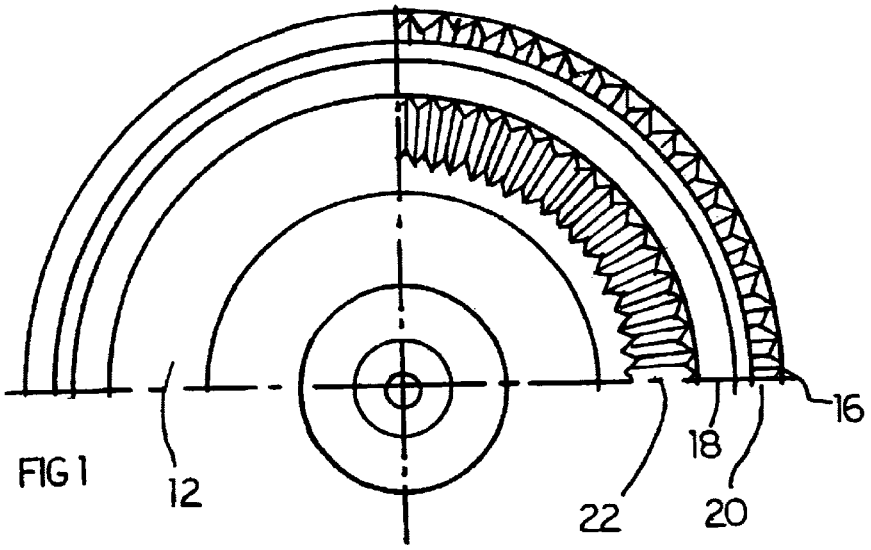
FIG. 1 is a partial plan view of a luminaire constructed in accordance with the present invention.
Figure 2:
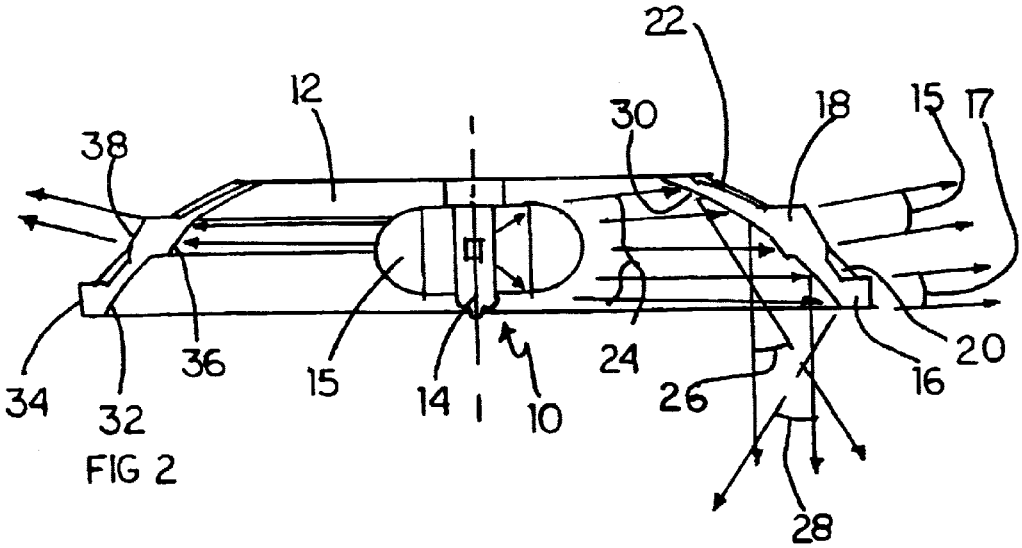
FIG. 2 is a schematic sectional view of the luminaire shown in FIG. 1.

FIGS. 1 and 2 illustrate respectively a partial plan and section views of a luminaire comprised of a radial collimator 10 surrounded by a ring refractor or ring lens 12. Radial collimator 10 is comprised of a quasi-point source 14 (a filament or an arc lamp) surrounded by a spherical or an aspheric ring collimator 15. Other types of ring collimators that can be employed in this system are illustrated U.S. Pat. No. 5,897,201. Refractive ring 12 is a composite of alternating wedge prism bands 16 and 18 and reflective prism bands 20 and 22.

Wedge prism bands 16 and 18 receive rays 24 from the radial collimator 10 and bend them at an acute angle upwardly as rays 17 and 19, respectively, for use as indirect illumination, while reflective prism bands 20 (lower) and 22 (upper) function by total internal reflection to reflect radially projected rays 24 as rays 26 and 28 in a downward pattern. The sectional contour 30 of prism bands 20 and 22 is designed to reflect radially collimated rays 24 in a predetermined continuous pattern of rays 26 and 28, respectively. The section contour of 20 and 22 may differ from each other so that a predetermined continuity of illumination derived from 26 and 28 is achieved.

Wedge prism band 16 includes entry surface 32 which, in some instances, is the same surface (having the same contour) as the entry/exit surface of the prism bands 20 and 22. Concentric entry/exit surfaces 32 and 34 form a band which is thicker at the top than at the bottom, thus making a section of a wedge prism. If entry surface 32 has a sectional curvature, the wedge prism will not only bend rays 24 but will also cause them to converge or diverge, depending on whether the curvature is negative or positive.

Wedge prism band 18 has an alternate profile that differs from band 16 in that its entry surface 36 does not follow the same sectional profile as entry surface 30. This allows for rays 24 to enter the entry face of wedge prism band 18 at an angle closer to perpendicular than the entry angle for prism 16. The exit surface 38 of prism band 18 is also shown.

Figure 9:
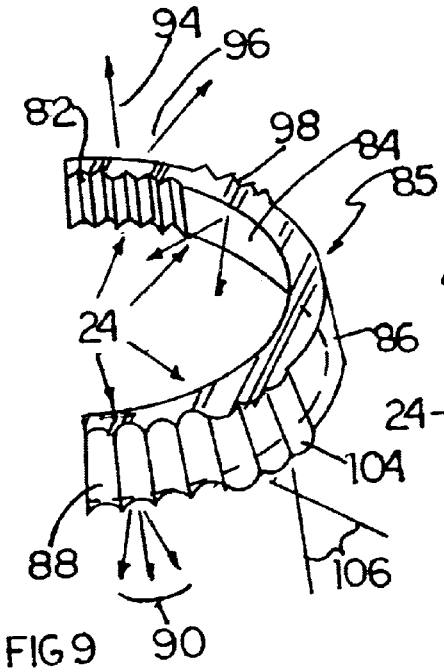
FIG. 9 is a partial isometric view of a wedge prism ring section of FIGS. 1 and 2

Details for surface treatments of prism 18 are illustrated on FIG. 9. The function of this luminaire is to provide both direct and indirect illumination simultaneously. The number of wedge prism bands and reflective prism bands and the ratio between them may differ from one luminaire to another.

Figure 3:
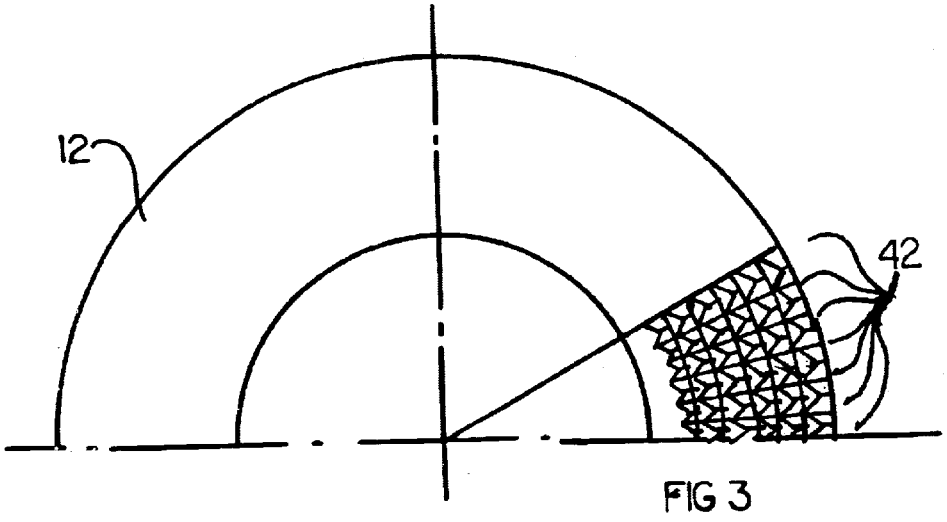
FIG. 3 is a partial plan view of another luminaire constructed in accordance with the present invention.
Figure 4:
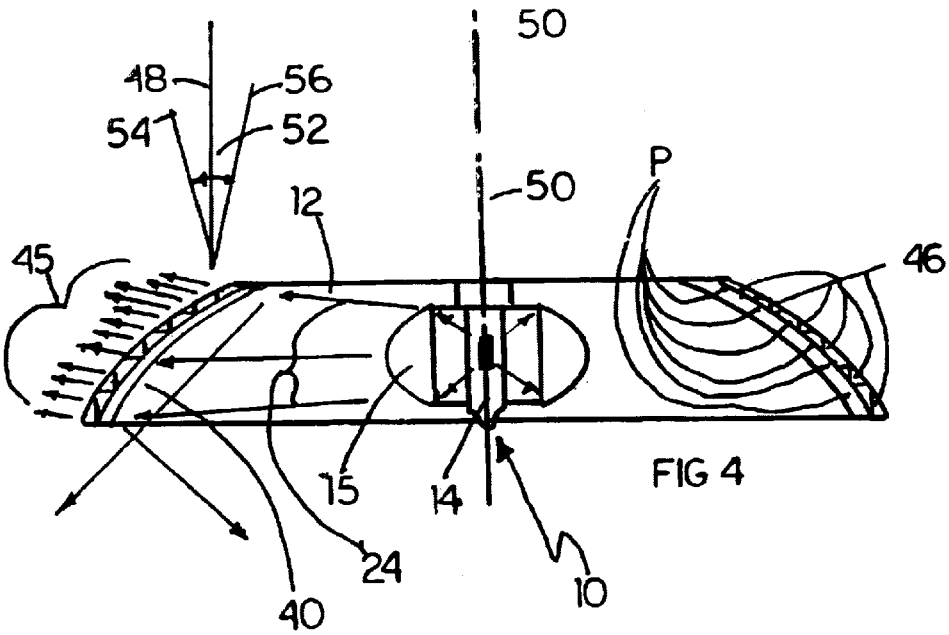
FIG. 4 is a schematic sectional view of the luminaire shown in FIG. 3.
Figure 8:
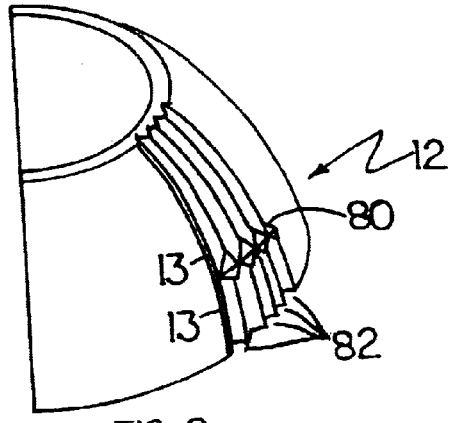
FIG. 8 is a partial isometric view of a ring refractor of FIGS. 3 and 4.

FIGS. 3 and 4 illustrate a luminaire that provides a similar lighting function to the luminaire described in FIGS. 1 and 2. Similar elements are provided with the same reference numerals. Refractive ring 12 is comprised of an inner surface 40 and an outer surface which includes prisms 42. The peaks and valleys of the prisms 42 forming the outer surface are substantially concentric with inner surface 40. An example of this is shown in FIG. 8. Inner surface 40 is the entry surface to prisms 42, which reflect rays 24 by means of total internal reflection.

Indirect rays 44 are created by adding exit faces 46 to prisms 42. Exit faces 46 are created by cutting into and removing an angular section of the peak of prisms 42, line 48 representing the vertical face of exit faces 46. However, instead of cutting the structure could be molded into the desired shape. Line 48 is shown (see FIG. 4) being parallel to central axis 50, although the face angle may be altered (changing the angle of indirect rays 44) as illustrated by shifting the angle of line 48 (within angle 52) towards position 54 or position 56. Details concerning surface shape, locations and quantities of surfaces 46 are illustrated in FIG. 8.

Figure 5:
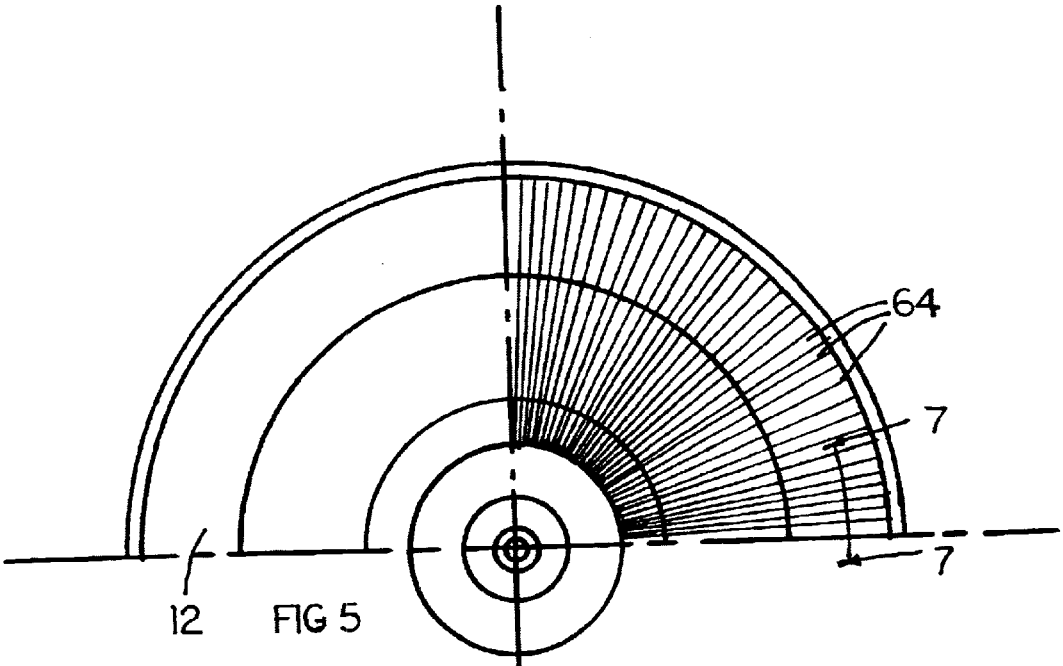
FIG. 5 is a partial plan view of a further luminaire constructed in accordance with the present invention.
Figure 6:
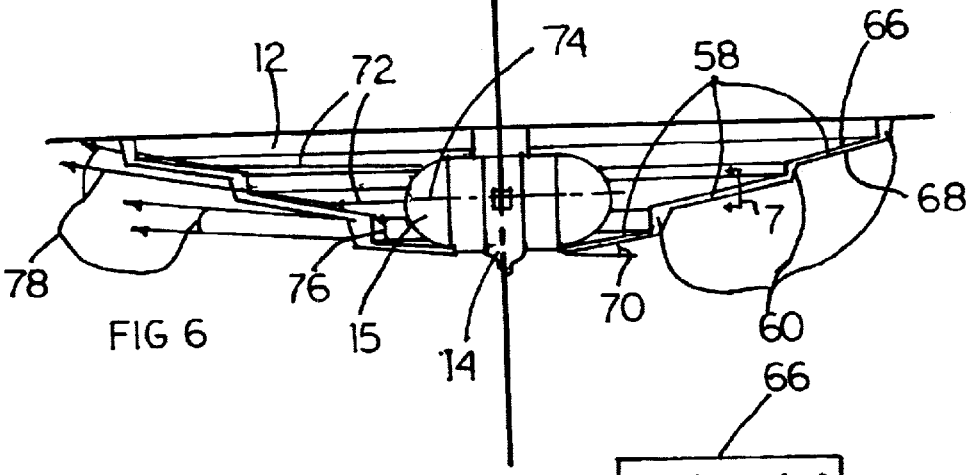
FIG. 6 is a schematic sectional view of the luminaire shown in FIG. 5.

FIGS. 5 and 6 illustrate, respectively, a partial plan view and a sectional view of a luminaire having a primary function of indirect illumination. The system is comprised of a radial collimator 15 (see description of FIGS. 1 and 2) and a refractive ring 12. Refractive ring 12 includes a concentric band of reflecting prism rings 58 alternating with a band of wedge prism rings 60.

The bands of FIGS. 1 and 2 and of FIGS. 5 and 6 can be provided with different vertical heights to vary the bands of light from the refractive bands forming the refractive ring 12.

Figure 7:
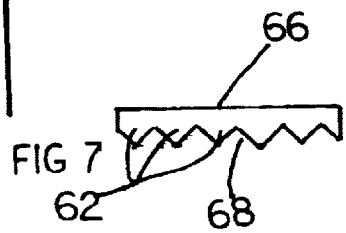
FIG. 7 is a sectional view taken generally along the plane defined by reference line 7—7 in FIGS. 5 and 6.

FIG. 7 is a partial sectional view of reflecting prism ring 58 taken at section line 7—7 in FIGS. 5 and 6. FIGS. 5 and 7 illustrate prisms 62 radiating along radii 64. The top surface 66 of ring 58 is polished. The lower surface 68 which includes prism surfaces 62, is also polished. Prism ring 58 may be canted (illustrated by angle 70) to intercept and reflect rays 72 and direct them by total internal reflection through rings 60, or it may be parallel to the center of radiation 74 reflecting rays that are expanding away from center of radiation 74. Wedge prism rings 58 function to bend radial rays 76 as refracted indirect rays 78.

FIG. 8 is an isometric view of the type of refractor ring 12 illustrated in FIGS. 3 and 4, showing wedge prism exit faces 80 intercepting and cutting through prism peaks 82.

FIG. 9 is an isometric view of a wedge prism ring section 85 of ring refractor 12 illustrated in FIGS. 1 and 2. Both the entry face 84 and/or the exit face 86 can have the illustrated types of applied vertical fluting, each type of fluting having an associated effect on rays 24 received from the central collimating light source shown in FIGS. 1–6. Concave fluting 88 causes rays 24 to diverge on the same plane as rays 24 as shown at 90. Convex fluting 104 causes rays 24 to be redirected as rays 106 which converge then diverge, also on the same plane as rays 24. Internal prism fluting 92 causes rays 24 to bi-directionally diverge as rays 94 and 96. External prism flute 98 causes rays 24 to bi-directionally diverge as rays back through entry face 84 as rays 98 and 100.

Figure 10:
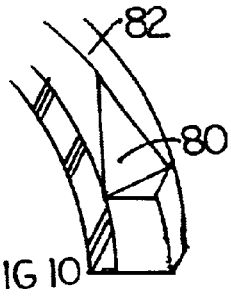
FIG. 10 is a partial sectional view of the structure shown in FIG. 8.

FIG. 10 is a partial view partially in section showing a single exit face 80 of FIG. 8 (and of FIGS. 3 and 4) as a flat surface.

Figure 11:
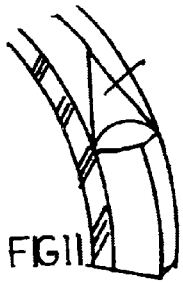
FIG. 11 is a partial sectional view of a modified structure of FIG. 8.

FIG. 11 illustrates a single exit face 108 as a cylindrically concave surface.

Figure 12:
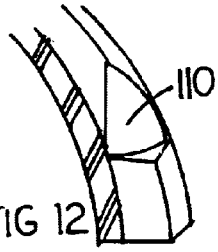
FIG. 12 is a partial sectional view of a further modified structure of FIG. 8.

FIG. 12 illustrates a single exit face 110 as a cylindrically convex surface.

Figure 13:
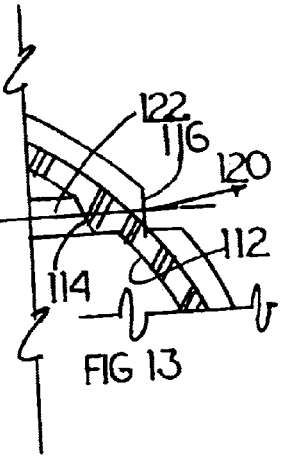
FIG. 13 is a sectional view taken generally along the plane defined by reference line 13—13 of FIG. 8.

FIG. 13 is a partial section of FIG. 8 with an internal prismatic band 120, the surface of which is at a dissimilar angle to the internal face 112 of the refractive ring 12. The vertical angular relationship of entry face 114 to exit face 116 determines the deviant angle 118 between projected beam 24 and refracted beam 120.

Figure 14:
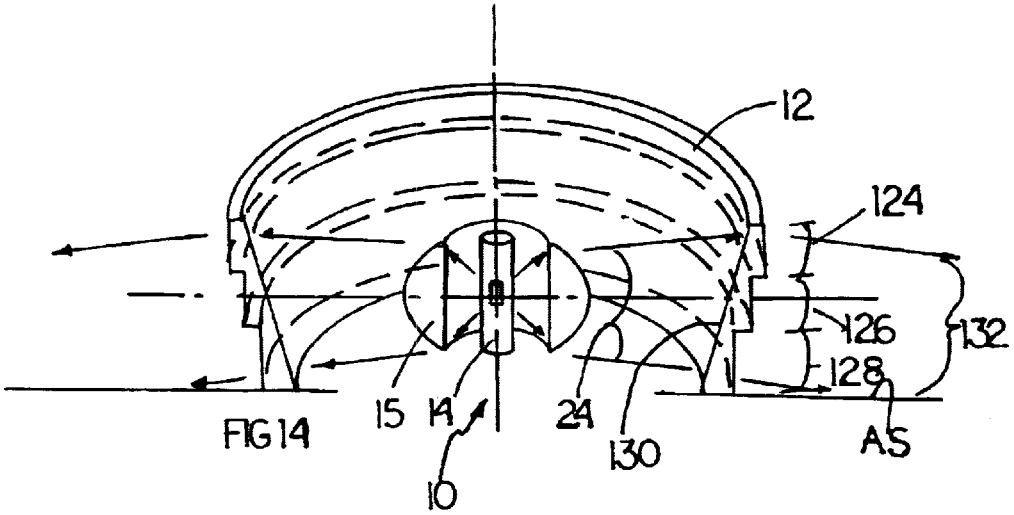
FIG. 14 is a partial isometric view of a luminaire.

FIG. 14 is a partial isometric view of a luminaire containing a ring collimator 10 and a refractive ring 12. Refractive ring 12 is a composite of wedge prism rings 124, 126 and 128. All three rings have a common conical entry face, which is the interior surface 130 of refractive ring 12. Wedge prism segments 124, 126 and 128 all have equal wedge prism angular profiles and therefore bend radially projected rays 24 in a consistent angle as rays 132. AS is a surface to which the assembly may be mounted, but it could be mounted in a different manner. If the assembly is mounted on plane AS rays 32 will illuminate surface AS.

Figure 15:
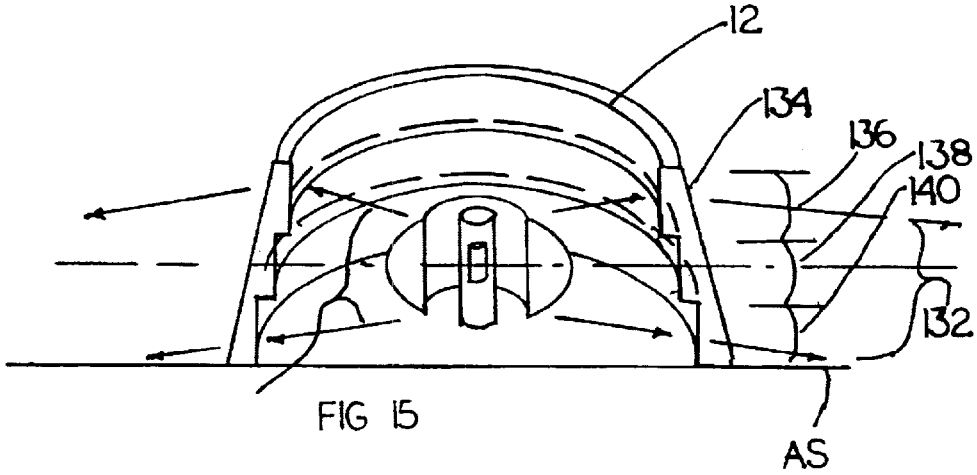
FIG. 15 is a partial isometric view of a similar luminaire.

FIG. 15 is a partial isometric view of a luminaire that has virtually the same function as the luminaire illustrated in FIG. 14, differing only in that the conical surface of FIG. 15 wedge prism ring 12 is on the outside having wedge prism segments 136, 138 and 140, and functioning as the exit surface 134, rather than on the inside as in FIG. 14.

Figure 16:
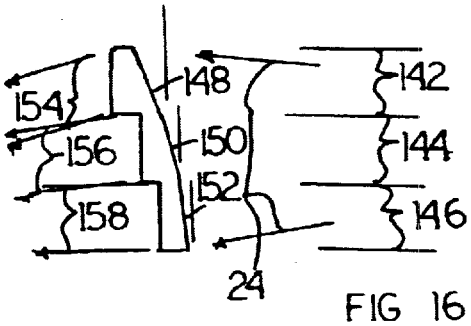
FIG. 16 is a sectional view having wedge prisms with a progressively more acute angle between the entry faces and the exit faces.

FIG. 16 represents a sectional view of refractive ring 12, differing from the section of refractive ring 12 shown in FIG. 14 in that each wedge prism section in FIG. 16, that is 142, 144 and 146 has a progressively more acute angle between the entry faces and the exit faces (illustrated by wedge angles, 148, 150 and 152) and providing rays 154, 156 and 158, respectively, than in FIG. 14, and, therefore, has less beam bending power. FIGS. 14, 15 and 16 represent variations of luminaire structures described in U.S. Pat. No. 5,897,201.

Figure 17:
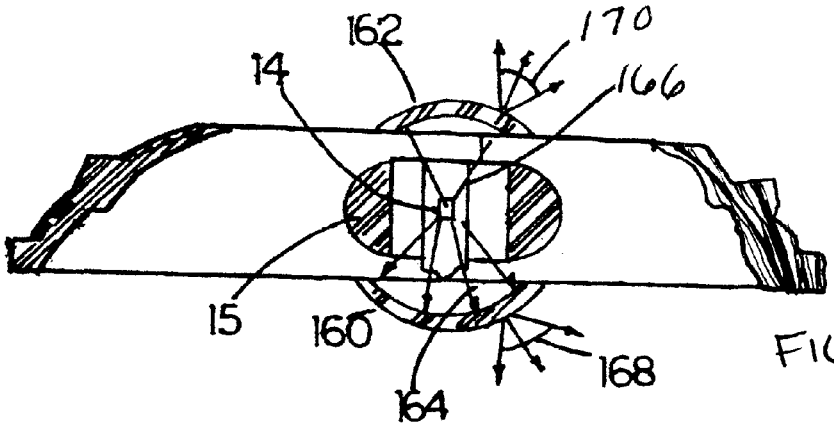
FIG. 17 is a sectional view of a luminarie structure similar to that shown in FIG. 2 having scattering refractor elements.

FIG. 17 represents the same luminaire structure as is shown in FIG. 2, with the addition of refractor elements 160 and 162 which scatter rays 164 and 166 (rays emanating from lamp 14 but not gathered by ring lens 12) as scattered rays 168 and 170, respectively. Refractor elements 160 and 162 may be bowl shaped, as shown, or flat, and may be surfaced with various refractive elements.

Figure 18:
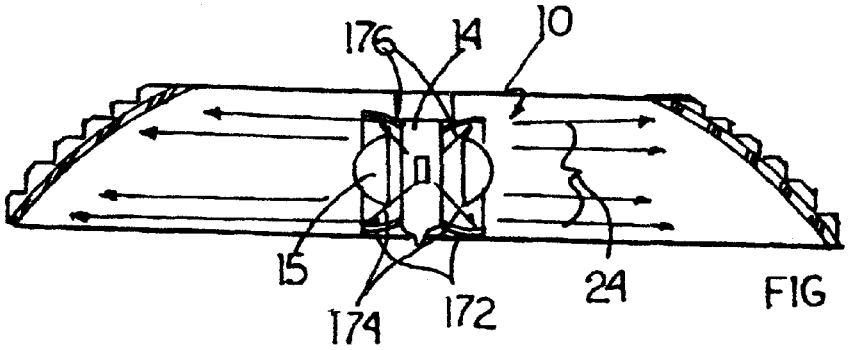
FIG. 18 is a sectional view similar to that shown in FIG. 4 having reflectors by the light source.

FIG. 18 represents the same luminarie structure as shown in FIG. 4 with the addition of radially disposed parabolic or ellipsoidal reflectors 172 that gather rays (not gathered by radially collimating rings 15) 174 and 176 and project them as rays 24.

Figure 19:
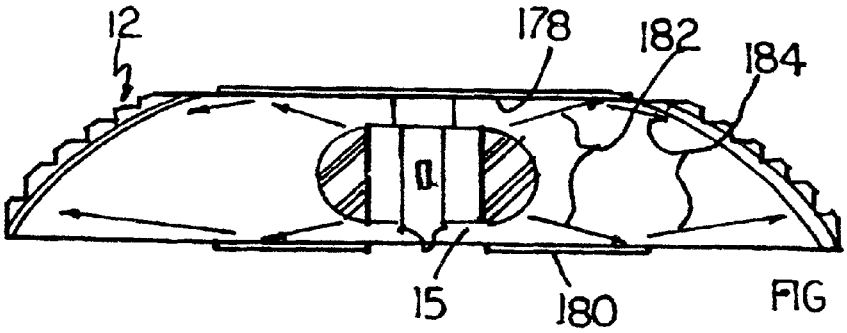
FIG. 19 is a sectional view similar to that shown in FIG. 4 having containment means.

FIG. 19 represents the same luminaire structure as represented in FIG. 4 with the addition of containment means 178 and 180 which may function as reflectors or as element 58 in FIG. 6, and are also described in U.S. Pat. No. 5,897,201.

Divergent rays 182 are reflected by 178 and 180 towards refractive ring 12 as rays 184. Refractor elements 160 and 162, reflectors 172, and containment means 178 and 180 are all interchangeable with all luminaires described in this specification and may be used in any combination with each other.

Figure 20:
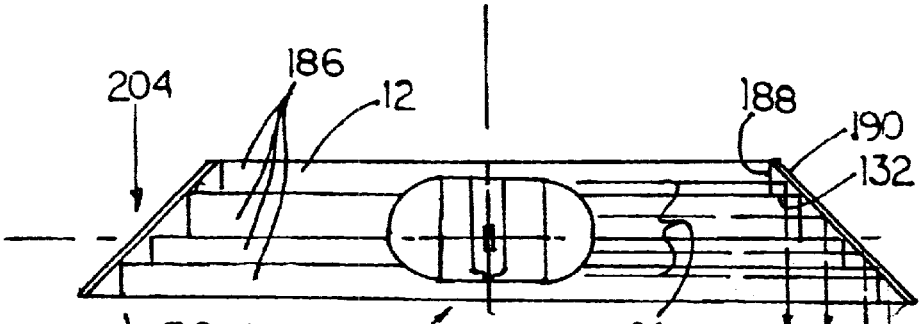
FIG. 20 is a sectional view of a luminaire with a radial collimator and refractive multi-prism rings.

FIG. 20 is a cross sectional view of a luminaire containing radial collimator 10 and refractive ring 12. Refractive ring 12 includes prism rings 186. Prism rings 186 are stepped concentrically from each other, with each ring having a cross section of a 90 degree, 45 degree, 45 degree prism. Each prism ring 186 has an entry face 188 that receives radially collimated rays 24 from radial collimator 10 and reflects the rays 24 (through total internal reflection) by prism face 190, the surface of which is common to all prism rings 186. Rays 24 reflected by face 190 leave exit surfaces 192 as rays 194.

Figure 21:
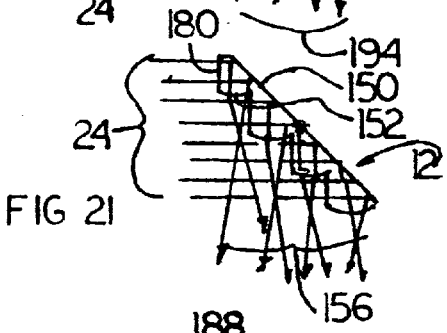
FIG. 21 is a partial cross sectional view of a refractive ring of FIG. 20.

FIG. 21 is a partial cross section of the refractive ring 12 of FIG. 20. It shows a radially continuous convex exit surface, causing exit rays 196 to radially converge then diverge.

Figure 22:
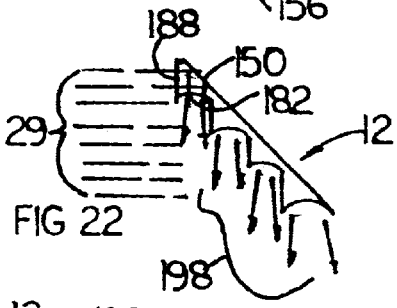
FIG. 22 is a partial cross section of the refractive ring of FIG. 20.

FIG. 22 is a partial cross section of refractive ring 12 of FIG. 20 illustrating a radially continuous concave surface, causing exit rays 198 to radially diverge.

Figure 23:
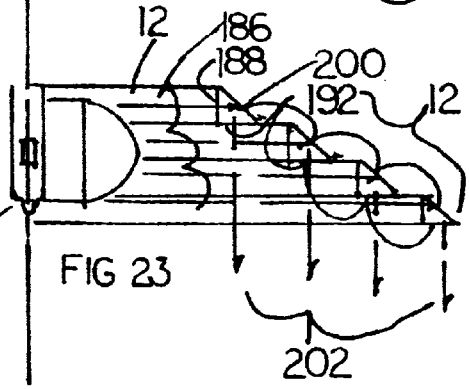
FIG. 23 is a partial cross section of a luminaire with a radial collimator and refractive ring.

FIG. 23 is a partial cross section of a luminaire containing radial collimator 10 and refractive ring 12. Refractive ring 12 includes prism rings 186 (similar in structure to the prism rings of FIG. 20), each prism ring having its own refractive face 200. Each prism ring 186 is concentrically spaced away from and separate from each other. The concentric distance between exit rays 202 is therefore increased.

Figure 24:
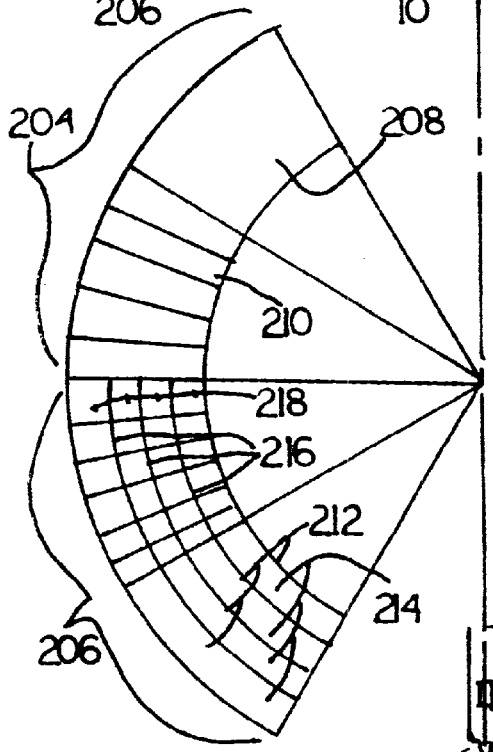
FIG. 24 is a partial plan view, the upper portion showing a top view of the refractor ring in FIG. 20 and the lower portion showing a bottom view of the ring.

FIG. 24 is a partial plan and partial bottom view of the prism ring 186 of FIG. 20. Section 204 is a view from the top of the ring 186 and section 206 is a view from the bottom of the ring 186. Section 204 shows two variations of the common (or non-common) reflective surface 190. Variation one 208 is a continuous conical surface; Variation two shows 210 surfaces axially segmented and disposed along 190 that can be flat, concave or convex. Section 206 shows two variations of the entry and exit surface of the prism rings. The first variation shows entry surfaces 212 and exit surfaces 214 having continuous circular surfaces with sectional profile options of FIGS. 20, 21, 22 and 23. The second variation shows segmented and radially divided entry faces 216 and exit faces 218. Entry face segments 216 and exit face segments 218 may be cylindrically concave, cylindrically convex, flat, concave, or convex. Individual ring segment 186 (having any of the described profiles or surfaces) may be used in conjunction with prism or wedge prism rings described in herein.

Figures 25, 26:
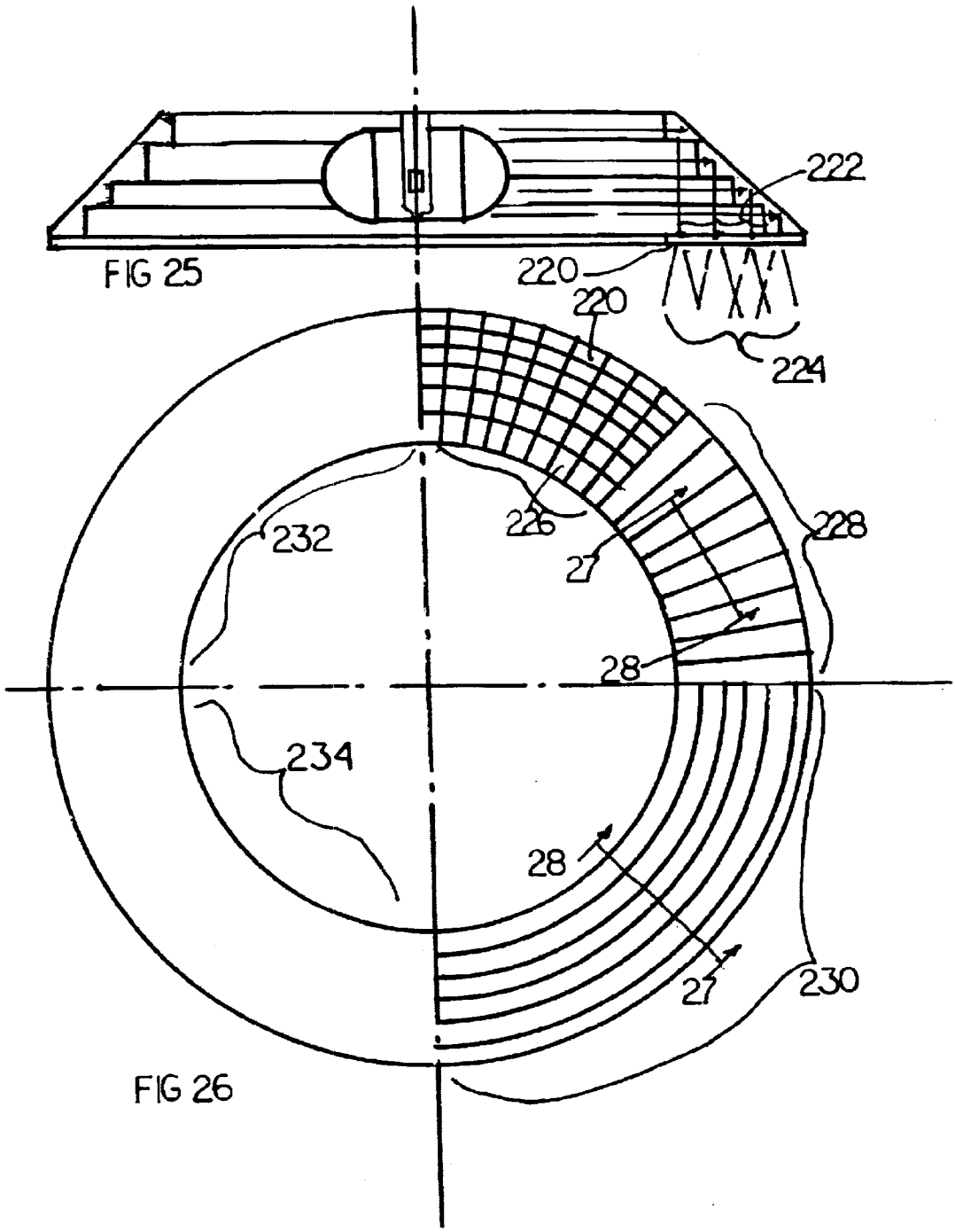
FIG. 25 is a cross section of a luminaire similar to that shown in FIG. 20.
FIG. 26 is a plan view of the structure shown in FIG. 25.

FIG. 25 is a cross section of a luminaire having the same structure as the luminaire shown in FIG. 20, with additional component refractive radial disk 220, which refracts exit rays 222 as refracted rays 224.

Figure 27:
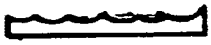
FIG. 27 is a cross section taken generally along the plane defined by reference line 27–28 in FIG. 26.
Figure 28:
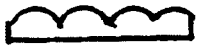
FIG. 28 is a cross section taken generally along the plane defined by reference line 28–27 in FIG. 26.

FIG. 26 shows a plan view of radial disk 220 and is divided into five sections, 226, 228, 230, 232 and 234, each representing a different refractive section. The surface of section 226 is radially and axially divided into convex or concave surfaces, forming positive or negative pillow lenses, respectively. The surface of 228 is divided into radial sections that may be concave or convex. A cutaway section is shown in FIGS. 27 and 28. The surface of 230 is concentrically divided into concave or convex fluting. A cutaway section is shown in FIGS. 27 and 28. The surface of section 232 is sandblasted or opalized. The surface of section 234 is coated with infrared ultraviolet filtering film.

Figure 29:
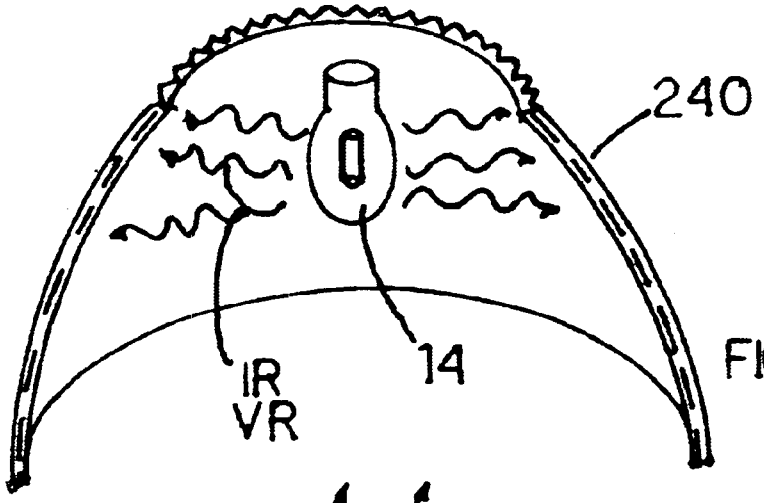
FIG. 29 is a section through a prior art device.
Figure 30:
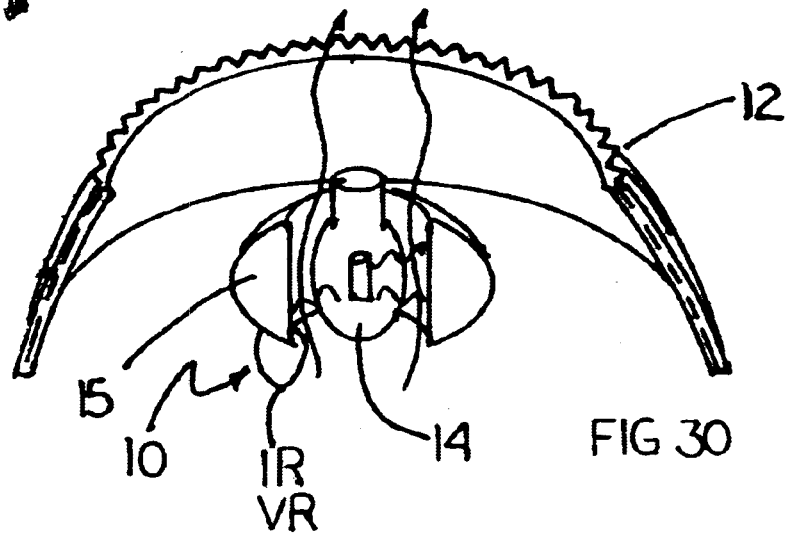
FIG. 30 is a section through a lighting arrangement according to the present invention.

FIG. 29 is an existing state of the art prismatic reflector/refractor luminaire and FIG. 30 is a luminaire including a radial collimator 10 and a prismatic ring 12. Both the reflector/refractor 240 of FIG. 29 and the refractor ring 12 of FIG. 30 have a similar prismatic structure with a curved (circular, parabolic, or ellipsoidal) cross section, a polished interior surface, and an outer surface covered with elongated prisms (running top to bottom) that act as total internal reflectors. Reflector/refractor 240 receives both infrared (IR) and ultraviolet (UV) radiation directly from lamp 14, and is therefore subject to deterioration. Ring collimator 10, if made of glass, can filter a percentage of the harmful UV and/or be treated, inside and outside, with UV and IR inhibiting coatings, cutting down or eliminating deterioration of prismatic ring 12.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A light assembly comprising:

a. a light source;

b. a ring lens radially surrounding said light source for substantially collimating light from the light source;

c. a prism ring having at least two prism bands surrounding said ring lens and receiving light therefrom, one of said prism bands being defined by a plurality of individual internally reflecting prisms arranged to reflect light downwardly away from the light source and from the other prism band, another of said prism bands being a refracting band formed of a plurality of individual prisms and refracting light in a different direction than said one prism band, whereby to provide light from the assembly in different directions.

2. A light assembly as defined in claim 1 wherein the ring prism bands have different vertical heights with respect to each other.

3. A light assembly as defined in claim 1 wherein the ring prism bands have the same vertical heights with respect to each other.

4. A light assembly as defined in claim 1 wherein said ring lens has coatings thereon to inhibit the transmission of IR and IV radiation.

5. A light assembly as defined in claim 1 wherein there are more than two prism bands which alternate between internally reflecting prism bands and refracting prism bands.

6. A light assembly comprising:

a. a light source;

b. a ring lens radially surrounding said light source for substantially collimating light from the light source;

c. a single band multi-prism ring reflector formed of a plurality of individual prisms surrounding said ring lens and arranged to have total internal reflection except for exit faces formed therein which are substantially at right angles to the substantially collimated light from the light source, the individual prisms performing both refracting and reflecting functions.

7. A light assembly comprising:

a. a light source;

b. a ring lens radially surrounding said light source for substantially collimating light from the light source;

c. a prism ring including at least two prism bands surrounding said ring lens and receiving light therefrom, each band being a prism in cross-section each of said bands having an inner surface and an outer surface, one of said surfaces of each band being inclined and adjacent another such surface and together therewith forming a continuous common surface, and the other of said surfaces of each band forming a wedge prism.

8. A light assembly as defined in claim 7 wherein said inclined surfaces form a continuous conical surface and are the inner surfaces.

9. A light assembly as defined in claim 7 wherein said inclined surfaces form a continuous conical surface and are the outer surfaces.

10. A light assembly as defined in claim 7 wherein said inclined surfaces are at a slightly different angle for each band and the inner surface of the wedge prisms form a stepped conical surface.

11. A light assembly as defined in claim 7 wherein the inner continuous furface is free of prisms.

12. A light assembly comprising:

a. a light source;

b. a ring lens radially surrounding said light source for substantially collimating light from the light source;

c. a prism ring including at least two refracting prism bands each formed of a plurality of individual prisms surrounding said ring lens and receiving light therefrom; and light modifying means above and below the light source for receiving rays of light which are not collimated by said ring lens.

13. A light assembly as defined in claim 12 wherein said light modifying means are reflectors immediately adjacent the light source for reflecting light from said source to be parallel to light from the ring lens.

14. A light assembly comprising:

a. a light source;

b. a ring lens radially surrounding said light source for substantially collimating light from the light source;

c. a prism ring including at least two refracting prism bands surrounding said ring lens and receiving light therefrom; and d. light modifying means above and below the light source for receiving rays of light which do not impinge upon the bands, said light modifying means being refractors for scattering the light rays which impinge thereon.

15. A light assembly comprising:

a. a light source;

b. a ring lens radially surrounding said light source for substantially collimating light from the light source;

c. a prism ring including at least two refracting prism bands surrounding said ring lens and receiving light therefrom; and d. light containment means located adjacent the top and bottom of said prism ring, said containment means being planar and redirecting diverging rays from the ring lens toward the prism ring.

16. A light assembly comprising:

a. a light source;

b. a ring lens radially surrounding said light source for substantially collimating light from the light source;

c. a prism ring including at least two refracting prism bands surrounding said ring lens and receiving light therefrom, said bands being formed of individual prisms and stepped concentrically from each other, and each having a cross section which includes a 90 degree, 45 degree and 45 degree prism.

17. A light assembly as defined in claim 16 wherein each prism band has an entry face which receives radially collimated rays from the ring lens and reflects the rays through total internal reflection by prism faces of the prism bands, the surface of which is common to all prism bands.

18. A light assembly as defined in claim 17 wherein there is a refractive radial disk at the bottom of the prism bands.

19. A light assembly as defined in claim 18 wherein said radial disk has a plurality of sections, each of which provides a different refractive effect from the other sections.

20. A light assembly as defined in claim 16 wherein the prism bands have radially continuous convex exit surfaces.

21. A light assembly as defined in claim 16 wherein the prism bands have radially continuous concave exit surfaces.

22. A light assembly as defined in claim 16 where said prism bands are stepped concentrically and the reflective surface of such bands is discontinuous with respect to one another.

23. An optical lighting system, comprising:

a. a light source;

b. a ring lens for radially collimating light from the source; and c. a multifaceted prismatic ring having multiple facets for redirecting the radially collimated light into two distinct distributions.

24. A lighting system as defined in claim 23, wherein said prismatic ring facets refract and segment the collimated light so that the light source cannot be seen through the prismatic ring.

25. A lighting system as defined in claim 23, wherein said two distinct light distributions do not overlap.

26. A light assembly comprising:

a. a light source;

b. a ring lends radially surrounding said light source for substantially collimating light from the light source;

c. a concentric band of reflecting prism rings surrounding the ring lens for reflecting collimated light from the ring lens and alternating with a band of wedge prism rings for refracting light reflected from the prism ring and also refracting direct light from the ring lens.

* * * * *